US009770072B2

(12) United States Patent
Hortnagl

(10) Patent No.: US 9,770,072 B2
(45) Date of Patent: Sep. 26, 2017

(54) BUCKLE COMPONENT

(71) Applicant: ABA Hortnagl GmbH, Fulpmes (AT)

(72) Inventor: Andreas Hortnagl, Fulpmes (AT)

(73) Assignee: ABA HORTNAGL GMBH, Fulpmes (AT)

( * ) Notice: Subject to any disclaimer, the term of this patent is extended or adjusted under 35 U.S.C. 154(b) by 0 days.

(21) Appl. No.: 14/481,090

(22) Filed: Sep. 9, 2014

(65) Prior Publication Data

US 2015/0067989 A1 Mar. 12, 2015

(30) Foreign Application Priority Data

Sep. 9, 2013 (AT) ..... A 693/2013

(51) Int. Cl.

| | |
|---|---|
| ***A44B 11/00*** | (2006.01) |
| ***A44B 11/25*** | (2006.01) |
| ***A44B 11/02*** | (2006.01) |
| ***A44B 11/26*** | (2006.01) |
| *A44B 11/04* | (2006.01) |

(52) U.S. Cl.

CPC ..... *A44B 11/02* (2013.01); *A44B 11/006* (2013.01); *A44B 11/25* (2013.01); *A44B 11/2592* (2013.01); *A44B 11/266* (2013.01); *A44B 11/04* (2013.01); *A44B 11/2515* (2013.01); *A44B 11/2553* (2013.01); *Y10T 24/4086* (2015.01)

(58) Field of Classification Search

CPC ..... A44B 11/02; A44B 11/006; A44B 11/25; A44B 11/2592; A44B 11/266

USPC ..... 24/196, 197, 170, 171

See application file for complete search history.

(56) References Cited

U.S. PATENT DOCUMENTS 688,503 A * 12/1901 Cross ..... A44B 11/24 24/163 R
1,344,955 A * 6/1920 Morse ..... A44B 11/08 24/171
1,718,274 A * 6/1929 Carlson ..... A44B 11/02 24/170
1,827,017 A * 10/1931 Joyce ..... A41F 11/00 24/197
1,827,331 A * 10/1931 Peterson ..... A44B 11/02 24/163 R (Continued)

FOREIGN PATENT DOCUMENTS

AT 506290 A4 8/2009
DE 3021387 A1 12/1981

(Continued)

OTHER PUBLICATIONS

Example buckle drawing, admitted prior art, Jan. 1, 2010.

*Primary Examiner* — Robert J Sandy
*Assistant Examiner* — Jason W San
(74) *Attorney, Agent, or Firm* — Vople & Koenig, P.C.

(57) ABSTRACT

Buckle component (1) having a belt receiving opening (2) and a frame (3) enclosing the belt receiving opening (2), and a bar (4) about which the belt (5) is guidable, wherein the bar (4) is fastened to the frame (3), in a manner crossing, in particular completely crossing, the belt receiving opening (2), by at least one fastening device (6, 7) of the buckle component (1). The bar (4) is fastened to the frame by plastic deformation of the bar (4) and/or of at least one of the fastening devices (6, 7) and/or of the frame (3).

16 Claims, 2 Drawing Sheets

(56) References Cited

U.S. PATENT DOCUMENTS 1,836,923 A * 12/1931 Hodge ..... A44B 11/02 24/196
2,026,750 A * 1/1936 Reiter ..... A44B 11/02 24/186
2,079,981 A * 5/1937 Bednall ..... A44B 11/24 24/170
2,081,410 A * 5/1937 Stark ..... A44B 99/00 24/170
2,542,044 A * 2/1951 Miller ..... A44B 11/10 24/196
3,584,896 A 6/1971 Jantzen
3,584,996 A 6/1971 Jantzen
4,069,554 A * 1/1978 Minolla ..... A44B 11/10 24/171
4,184,234 A * 1/1980 Anthony ..... A44B 11/2557 24/171
4,371,192 A * 2/1983 Alix ..... B60R 22/19 24/171
4,392,277 A 7/1983 Müller
4,473,926 A * 10/1984 Ono ..... A44B 11/2557 24/194
4,525,901 A * 7/1985 Krauss ..... A44B 11/04 24/193
4,608,735 A * 9/1986 Kasai ..... A44B 11/10 24/171
4,637,099 A * 1/1987 Kasai ..... A44B 11/04 24/169
4,876,770 A * 10/1989 Bougher ..... A44B 11/2557 24/170
4,962,572 A * 10/1990 Prentkowski ..... A44B 11/2557 24/196
5,023,980 A * 6/1991 Thomas ..... A44B 11/10 24/171
5,050,274 A * 9/1991 Staniszewski ..... A44B 11/10 24/171
5,123,153 A * 6/1992 Krauss ..... A44B 11/10 24/171
5,222,278 A * 6/1993 Ball ..... A44B 11/2553 24/170
5,243,741 A * 9/1993 Fudaki ..... A44B 11/04 24/197
5,311,653 A * 5/1994 Merrick ..... A44B 11/10 24/171
5,331,726 A * 7/1994 Suh ..... A44B 11/10 24/196
5,417,455 A * 5/1995 Drinane ..... A44B 11/2557 24/171
5,600,875 A * 2/1997 Chang ..... A44B 11/02 24/163 R
5,649,341 A * 7/1997 Ashline ..... A44B 11/2557 24/171
5,651,166 A * 7/1997 Lundstedt ..... A44B 11/04 24/196
5,774,947 A * 7/1998 Anscher ..... A44B 11/06 24/171
5,832,569 A * 11/1998 Berg ..... A44B 11/12 24/170
5,870,816 A * 2/1999 McFalls ..... A44B 11/2553 24/170
6,148,486 A * 11/2000 Uehara ..... A44B 11/10 24/170
6,292,983 B1 * 9/2001 Giaquinta ..... A44B 11/006 24/163 R
6,665,915 B1 * 12/2003 Higuchi ..... A44B 11/006 24/615
7,010,836 B2 * 3/2006 Acton ..... A44B 11/2557 24/170
7,325,280 B2 * 2/2008 Ichida ..... A44B 11/2557 24/170
7,353,573 B2 * 4/2008 Anscher ..... A44B 11/006 24/170
D621,744 S 8/2010 Hörtnagl
8,322,000 B2 * 12/2012 Dziengowski ..... A44B 11/2561 24/171
8,561,268 B2 * 10/2013 Hortnagl ..... A44B 11/2592 24/625
8,667,651 B2 * 3/2014 Wang ..... A44B 11/005 24/170
8,695,181 B2 * 4/2014 Kaneko ..... A44B 11/266 24/615
8,793,844 B2 * 8/2014 McFalls ..... A44B 11/2553 24/170
8,813,316 B2 * 8/2014 Richter ..... B60R 22/18 24/168
8,820,788 B2 * 9/2014 Goudeau ..... A44B 11/2561 280/806
8,840,145 B2 * 9/2014 Bougher ..... A44B 11/2561 24/171
8,944,468 B2 * 2/2015 Cox ..... A44B 11/2561 280/801.1
9,015,912 B2 * 4/2015 Nanbu ..... A44B 11/266 24/615
9,022,483 B2 * 5/2015 Merrick ..... B60R 22/18 24/68 SB
9,351,526 B1 * 5/2016 Taylor ..... A44B 11/12
2003/0145435 A1 8/2003 Carver
2003/0182777 A1 * 10/2003 Kim ..... A44B 11/006 24/615
2003/0233737 A1 * 12/2003 Chen-Lieh ..... A63B 33/002 24/170
2006/0048350 A1 * 3/2006 Coulombe ..... A44B 11/253 24/634
2006/0070214 A1 * 4/2006 Hsu ..... A41F 15/002 24/170
2006/0185131 A1 * 8/2006 Anderson ..... A44B 11/006 24/171
2006/0248690 A1 * 11/2006 Yazzie, Sr. ..... A44B 11/10 24/197
2010/0122437 A1 * 5/2010 Hortnagl ..... A44B 11/02 24/163 R
2011/0108789 A1 5/2011 Boukal et al.
2011/0173783 A1 * 7/2011 Kaneko ..... A44B 11/266 24/615
2012/0198660 A1 * 8/2012 Richter ..... A44B 11/2526 24/170
2012/0198666 A1 * 8/2012 Nanbu ..... A44B 11/266 24/608
2014/0298630 A1 * 10/2014 Hortnagl ..... A44B 11/2592 24/697.2
2014/0317893 A1 * 10/2014 Takahashi ..... A44B 11/2546 24/580.11
2015/0150341 A1 * 6/2015 Singh ..... A44B 11/006 24/303
2015/0208768 A1 * 7/2015 Iannello ..... A44B 11/006 24/163 R

FOREIGN PATENT DOCUMENTS

| | | |
|---|---|---|
| DE | 20316449 U1 | 1/2004 |
| DM | 045484 | 10/1998 |
| EP | 1310183 A1 | 5/2003 |
| JP | H01126103 | 8/1989 |
| JP | 2005278735 | 10/2005 |
| WO | 2013099590 | 7/2013 |

* cited by examiner

Fig. 1
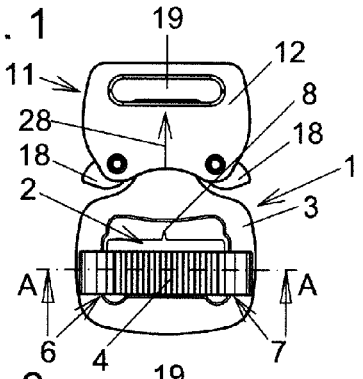
Fig. 2
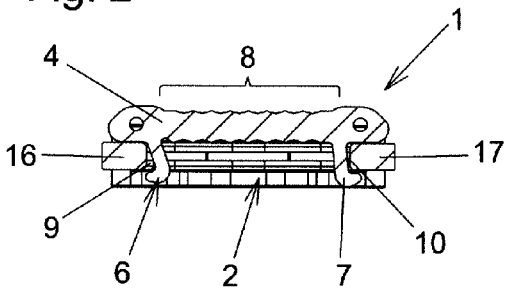
Fig. 3
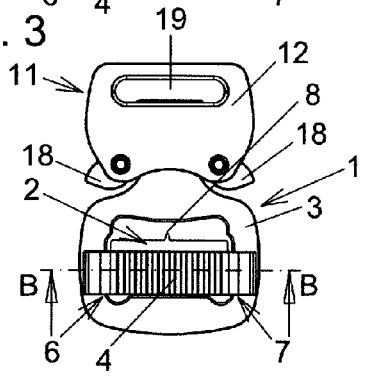
Fig. 4
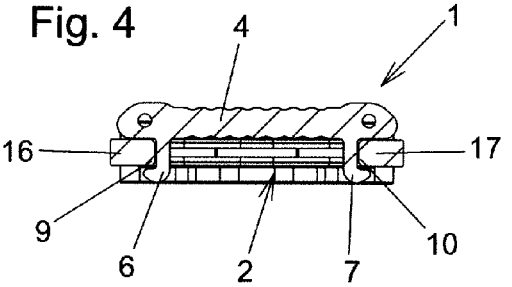
Fig. 5
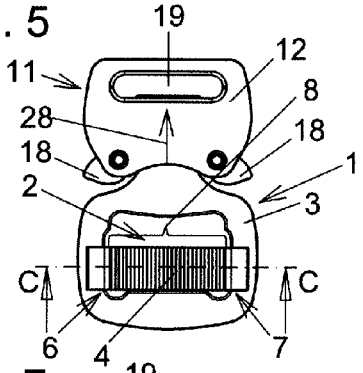
Fig. 6
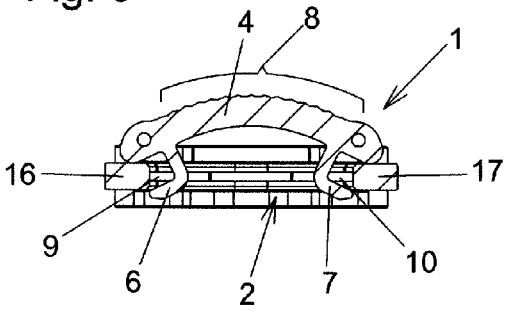
Fig. 7
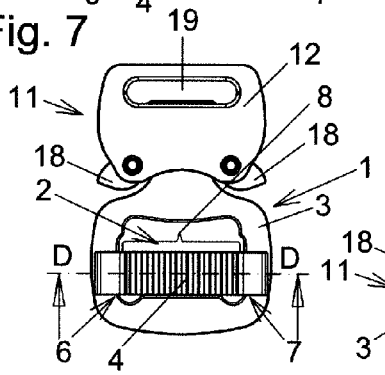
Fig. 8
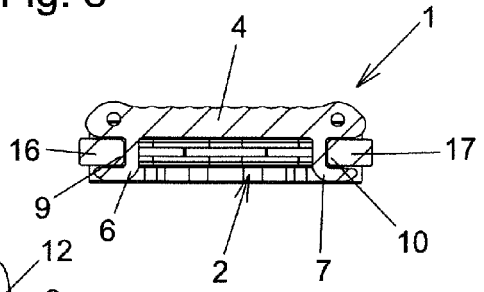
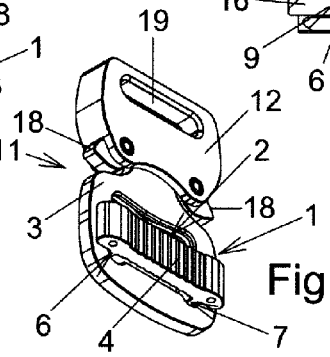
Fig. 9

BUCKLE COMPONENT

INCORPORATION BY REFERENCE

The following documents are incorporated herein by reference as if fully set forth: Austrian Patent Application A693/2013, filed Sep. 9, 2013.

BACKGROUND

The present invention relates to a buckle component having a belt receiving opening and a frame enclosing the belt receiving opening, and a bar about which the belt is guidable, wherein the bar is fastened to the frame, in a manner crossing, in particular completely crossing, the belt receiving opening, by at least one fastening device of the buckle component. Furthermore, the invention also relates to a buckle having at least one such buckle component and to a method for producing such a buckle component.

Buckle components of this type have been known in principle for a long time in the art. The bar serves for a belt to be able to be guided around it. The bars can be fastened in a fixed position in the frame. However, it is also known for the bars to be formed in a displaceable manner in the frame as clamping bars, in order to clamp the belt between the frame and the bar. Generic buckle components are known for example from the international design patent DM/045484.

SUMMARY

It is the object of the invention to simplify the production process for such buckle components.

This is achieved according to the invention in that the bar is fastened to the frame by plastic deformation of the bar and/or of at least one of the fastening devices and/or of the frame.

As a result of the invention, a cost-efficient and simple manner of attaching the bar to the frame is achieved. The plastic deformation of the bar and/or of at least one of the fastening devices and/or of the frame can be carried out mechanically using known means or manually, and then usually by way of a corresponding tool. Preferably, this is a simple cold forming method. The fact that the material of the bar and/or of the at least one fastening device and/or of the frame was plastically deformed can generally be proved on the finished product in a simple manner by way of a cut through the plastically deformed part. As a result of the deformation, bending lines have generally been produced in the plastically deformed material, said bending lines being easily and readily discernible using means known from the prior art and usually already visually.

In principle, all materials that are known from the prior art and do not break and are still sufficiently stable following plastic deformation, in particular following plastic cold deformation, can be used in order to form buckle components according to the invention. Particularly preferably, these are metals, for example aluminum. Very particularly preferably, these are extruded materials, in particular extruded metals, for example aluminum. Precision casting, continuous casting or rolled profiles can also be used as the basis for the components. It is also possible to use composite materials, for example comprised of a plastics material and a metal, as long as the component manufactured therefrom can be accordingly plastically deformed.

Once the bar has been fastened to the frame by said plastic deformation, the bar remains permanently fastened in the belt receiving opening. A belt can then be guided around the bar in a manner known per se in the belt receiving opening.

The frame can be embodied in a circumferentially closed manner. However, laterally open frames or frames that are not closed, which still enclose or surround the belt receiving opening, apart from the lateral opening in the frame, are also possible. This is also to be understood by enclosing of the belt receiving opening.

The fastening devices can act in a frictional and/or form-fitting manner, in particular engage with the frame. Particularly preferred configurations of the invention provide for the fastening device, preferably all of the fastening devices, to have, or to be formed of, a hook-shaped region provided to engage with the frame. The hook-shaped region may also be embodied or designated as a cross-sectionally C- or U-shaped region.

If the bar is fastened to the frame by plastic deformation of the frame, configurations can for example provide for the frame to have a hook-shaped and/or cross-sectionally U- or C-shaped region which encloses an opening in which for example a front end of the bar is then arranged. This hook or U- or C-shaped region of the frame can be formed, after insertion of the bar, by deformation of one of the side walls. The frame openings in which the bar then comes to rest can be blind-hole-like in cross section.

In preferred configurations, the bar has a central bar part. This is preferably arranged between the fastening devices. The bar is advantageously longitudinally extended. The same applies in preferred configurations also for the central bar part. This is thus also preferably extended in an elongate manner. The expression longitudinal or elongate extension is used when the length of the component is much greater than, for example at least twice as large as, its width and its height. Preferred configurations of the invention provide for the central bar part to be plastically deformed in order to fasten the bar to the frame.

However, the hook-shaped region(s) can also be plastically deformed equally well or in addition. Preferred configurations provide for at least one, preferably all, of the hook-shaped regions, as seen in cross section, to have a blind-hole-like opening in which a subregion of the frame or of the bar is arranged.

If the blind-hole-like openings are part of the hook-shaped regions of the fastening device, provision is advantageously made for the blind-hole-like openings to be open in directions facing away from one another. The open inlet openings are thus directed away from one another in these variants. By contrast, in the configuration with the blind-hole-like openings in the frame, provision is advantageously made for said openings to be open in the direction toward one another. Particularly preferred configurations of the invention provide for the bar and the fastening device are formed integrally of at least one continuous material. Preferably, the abovementioned materials are used here.

The bar can be displaceable in the belt receiving opening, as known per se, in a direction transversely, preferably orthogonally, to its longitudinal extension, in order to be used as a clamping bar. However, it can also be fastened to the frame in a nondisplaceable manner. In the event that the bar is fastened to the frame in a nondisplaceable manner by the fastening devices, provision can be made for that region or those regions of the frame with which the fastening device or fastening devices engage(s) in order to fasten the bar to the frame to have preferably channel-like or groove-like indentations in which the bar is held in a form-fitting manner by way of its fastening devices. In the case of a bar that is displaceable in the transverse direction, said regions of the frame in or with which the fastening device or fastening devices engage(s) are advantageously formed in a correspondingly smooth manner, at least in the region in which the bar is intended to be displaceable.

The fastening device or fastening devices can be part of the bar. The bar can be formed integrally with the fastening devices or fastening device. This can be for example achieved when the fastening device or the fastening devices are integrally formed on the central bar part.

However, the bar can also be constructed in a multipart manner, and the fastening devices or the fastening device can then be for example separate clamps or other fastening means that are subsequently fastened to the bar. Advantageously, these are fastened to the central bar part, preferably to the end regions of the central bar part. However, the fastening devices can also be parts that are formed initially completely separately from the bar or parts of the frame, or parts fastened to the frame.

Particularly simple embodiments of the invention can provide for the buckle component itself to already be the entire buckle. However, a buckle can also have a plurality of buckle components, of which at least one is formed in a manner according to the invention. In this context, provision can be made for the buckle component to have a connecting element for connecting, preferably in a lockable manner, to a corresponding connecting element of another buckle component. For example, provision can be made for one of the buckle components to be equipped with a male connecting element which is intended to be inserted into a connecting element, formed in a female manner, of the other buckle component and preferably to be locked there. This connection between the buckle components can be secured or locked by locking levers, as are known per se in the prior art. These locking levers are generally fastened to one of the buckle components in a displaceable or pivotable manner, usually with spring loading. Integral locking levers or locking levers that are connected in a multipart manner to the buckle component are known in principle in the prior art. All of these variants that are known from the prior art can also be used in buckle components according to the invention.

If the connecting elements for assembling the buckle components are plugged together in a plug-in direction, the bar can be fastenable or arranged on the frame in a manner parallel but also orthogonal to the plug-in direction. Other angular positions between the plug-in direction and the bar are also possible.

In addition to the buckle component according to the invention, the invention also relates to a buckle having at least two buckle components which each have at least one connecting element for connecting, preferably in a lockable manner, to a corresponding connecting element of the other of the buckle components, wherein at least one of the buckle components is a buckle component according to the invention.

A method for producing a buckle component according to the invention provides for the bar to be fastened to the frame by plastic deformation of the bar and/or of at least one of the fastening devices and/or of the frame. Further method steps can be gathered from the abovementioned descriptions of the buckle component or of the buckle, and so this does not have to be explicitly explained here again.

BRIEF DESCRIPTION OF THE DRAWINGS

Further features and details of preferred configurations of the invention are explained with reference to the following description of the Figures, in which:

FIGS. 1 to 4 show a buckle having a first buckle part according to the invention;

FIGS. 5 to 8 show another buckle having a buckle component according to the invention;

FIG. 9 shows a perspective illustration consistent with the two exemplary embodiments according to FIGS. 1 to 8;

DETAILED DESCRIPTION OF THE PREFERRED EMBODIMENTS

Figure 10:
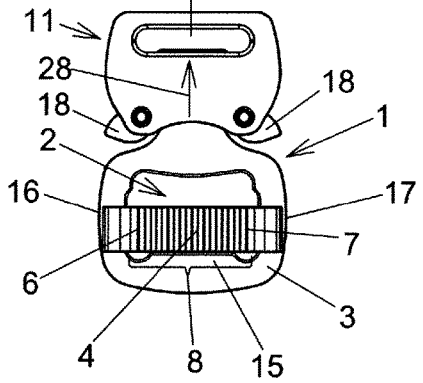
FIGS. 10 to 12 show illustrations of a third exemplary embodiment which is based on the second exemplary embodiment.

FIGS. 1 to 4, that is to say the first exemplary embodiment, concern a variant in which, in order to fasten the bar 4 in the frame 3, one of the fastening devices 6 is plastically deformed. FIG. 1 shows a front view and FIG. 2 the section along the section line AA in FIG. 1. FIG. 3 likewise shows a front view and FIG. 4 the section along the section line BB. FIGS. 1 and 2 show the situation following insertion of the bar 4 into the belt receiving opening 2, but before the plastic deformation of the fastening device 6. FIGS. 3 and 4 show the fully mounted bar 4 following plastic deformation of the fastening device 6.

Figure 13:
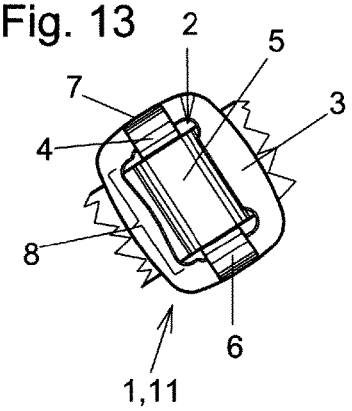
FIGS. 13 to 15 show three further exemplary embodiments according to the invention, wherein, however, the buckle consists of a single buckle component.
Figure 14:
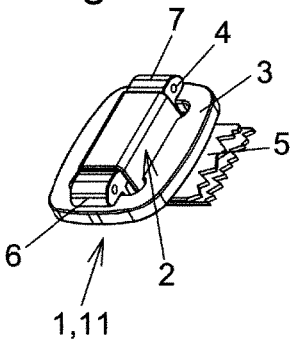
Figure 15:
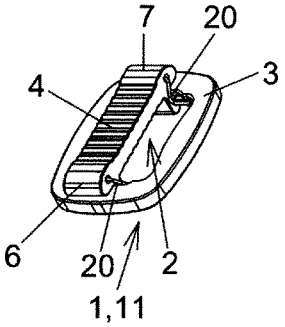

The buckle component 1, in which the bar 4 in the belt receiving opening 2 is fastened to the frame 3 by plastic deformation according to the invention, is part of the buckle 11. The buckle component 1 is thus connectable to the buckle component 12 in order in this way to form the buckle 11. In the exemplary embodiment shown, the buckle component 1 has, analogously to the sectional illustration according to FIG. 11, a male connecting element 13 which is inserted into the female connecting element 14 of the buckle component 12 in order to connect the two buckle components 1 and 12. Locking takes place via the locking levers 18 which engage behind the shoulders 23 in the position illustrated in FIG. 11 and thus prevent the male buckle component 1 from being pulled out of the female buckle component 12. The locking levers 18 are pivotable about the pivot axes 22 and are pretensioned in each case into the locking position by the pretensioning spring 21. For releasing, pressure has to be applied, as known per se, to the locking levers 18 in order to be able to pull the male connecting element 13 out of the female connecting element 14 in order in this way to separate the two buckle components 1 and 12. In the exemplary embodiment shown, the further buckle component 12 has a belt receiving opening 19 through which a belt 5 can be passed or in which a belt 5 can be fastened. All of this is known per se, for example from the buckles which are shown in the design patent mentioned at the beginning. Thus, further explanations in this regard can be dispensed with. Reference is merely made to the fact that of course an exemplary embodiment according to the invention of a buckle component 1 could also be equipped with corresponding female connecting elements 14 as the female buckle component. Furthermore, the invention is also applicable to buckles entirely without connecting elements, as are shown in FIGS. 13 to 15, and to other buckles and buckle components, in particular having other connecting elements and locking elements.

Returning to the first exemplary embodiment, reference is now made in detail first of all to the situation according to FIG. 2, that is to say to the situation before plastic deformation of the fastening device 6. The bar 4 is already located in the belt receiving opening 2, which it crosses. The fastening device 7 is already in engagement with the corresponding region 17 of the frame 3. The region 17 of the frame 3 is in this case arranged in the opening 10 in the hook-shaped region of the fastening device 7. By contrast, the fastening device 6 provided on the other side of the central bar part 8 is not yet in its final shape, and so the corresponding region 16 of the frame 3 is also not yet arranged in the opening 9 in the fastening device 6. The bar 4 is now fastened to the frame 3 or to the regions 16 and 17 thereof by plastic deformation of the fastening device 6 until the position according to FIG. 4 has been reached, in which position the deformation has been completed and the bar 4 is accordingly fully fastened to the frame 3, crossing the belt receiving opening 2. FIG. 4 clearly shows that the two openings 9 and 10 in the respectively hook-shaped regions of the fastening devices 6 and 7 are formed in a blind-hole-like manner in cross section. The regions 16 and 17 of the frame 3 are arranged in the blind-hole-like openings. The blind-hole-like openings 9 and 10 open in directions that face away from one another.

How the belt 5 is now guided around the bar 4 in the belt receiving opening 2 is not shown in FIGS. 1 and 3. However, this is shown by way of example in FIGS. 13 and 14. The belt 5 can be guided around the bar 4 in the belt receiving opening 2 in a similar manner in the first exemplary embodiment.

Reference is also made to the fact that the bar 4 in the first exemplary embodiment is a clamping bar that is displaceable in a direction orthogonally to its longitudinal extension, that is to say in this case parallel to the plug-in direction 28. It can thus also be displaced, in the fully mounted state, along the regions 16 and 17 of the frame 3 in order to firmly clamp the belt 5 in a manner known per se to one of the frame walls 15, delimiting the belt receiving opening 2, of the frame 3.

Of course, the bar 4 does not have to be a displaceable clamping bar. The bar 4 can also be arranged in a fixed position on the frame 3 or in the belt receiving opening 2. To this end, provision can be made for example for groove-like, notch-like or other types of recesses to be provided in the regions 16 or 17, the bar 4 and/or the fastening devices 6 and 7 engaging in a form-fitting manner in said recesses. Corresponding fixing of the bar 4 in its position in the belt receiving opening 2 can of course also be realized by a correspondingly firm friction fit between the fastening devices 6 and 7 and the regions 16 and 17 of the frame 3 and optionally also the bar 4.

It is advantageous in any case if, as also realized here, the bar 4 rests with its outer surfaces, facing the frame 3, on the outer surfaces, facing toward the bar 4, of the frame 3. The bar 4 thus rests advantageously on the outside of the frame 3. As a result, the torques that arise as a result of the pull on the belt 5 at the bar 4 are kept as small as possible.

The second exemplary embodiment of the invention according to FIGS. 5 to 8 is largely identical to the first exemplary embodiment, and so repetitions can be avoided in the overall description. Only the differences with respect to the first exemplary embodiment will be dealt with here. These differences consist in the fact that, in the second exemplary embodiment according to FIGS. 5 to 8, in order to fasten the bar 4 to the frame 3 it is not one of the fastening devices 6 or 7 that is plastically deformed but rather the central bar part 8. FIGS. 5 and 6 again show the state in which, although the bar 4 has already been arranged in the belt receiving opening 2, the plastic deformation for fastening the bar 4 to the frame 3 has not yet taken place. In this case, FIG. 6 is the section along the section line CC in FIG. 5. FIGS. 7 and 8 show the fully mounted state following plastic deformation. FIG. 8 is the section along the section line DD in FIG. 7. It can be seen particularly clearly in FIG. 6 that, in order to introduce the fastening devices 6 and 7, which are likewise formed in a hook-shaped manner here, into the belt receiving opening 2, the central bar part 8 has a bulge or lateral bend, or has been bent. The bulge is directed in a direction orthogonally or transversely to the longitudinal extension of the central bar part 8. By corresponding application of pressure on the central bar part 8 in a direction transversely to its longitudinal extension, the plastic deformation process then takes place, the situation according to FIGS. 7 and 8 arising at the end of this plastic deformation process. As a result of this plastic deformation process, the regions 16 and 17 of the frame 3 come to rest in the openings 9 and 10 in the fastening devices 6 and 7, said openings 9 and 10 being blind-hole-like in the cross section shown.

In this second exemplary embodiment, too, once it has been fully mounted, the bar 4 is mounted as a clamping bar on the frame 3 so as to be displaceable in the directions transversely to the longitudinal extension of the bar 4 or of the central bar part 8. However, by way of the means already described with respect to the first exemplary embodiment, the bar 4 can, in alternative configurations, also be fastened in a stationary manner in the belt receiving opening 2 in the frame 3.

FIG. 9 shows a perspective illustration of a buckle 1, in which the differences between the two exemplary embodiments according to FIGS. 1 to 4 and 5 to 8 cannot be seen. This perspective illustration according to FIG. 9 therefore illustrates both of the configurations described thus far.

Figure 11:
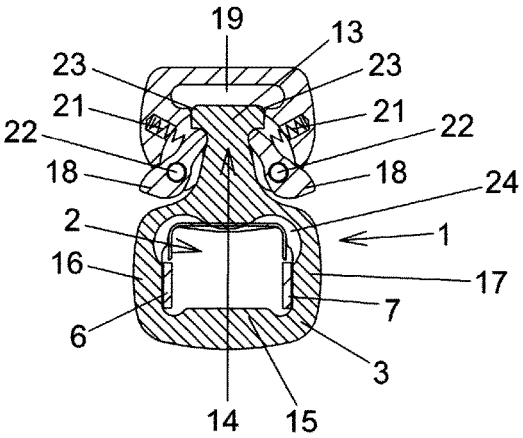
Figure 12:
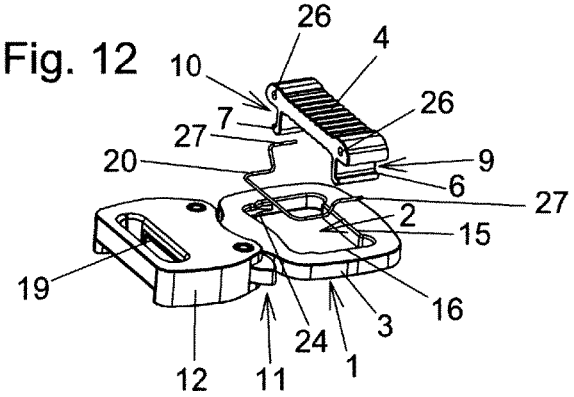

The third exemplary embodiment according to FIGS. 10 to 12 is based on the second exemplary embodiment according to FIGS. 5 to 8. However, in the third exemplary embodiment, a pretensioning spring 20 is additionally provided, said pretensioning spring 20 serving to press the bar 4, embodied here as a clamping bar that is displaceable in the belt receiving opening 2, against a frame wall 15 which delimits the belt receiving opening 2, in order to firmly clamp a belt 3, not illustrated in FIGS. 10 to 12, between the bar 4 and this frame wall 15. FIG. 10 shows a front view of the buckle 11. FIG. 11 shows a horizontal section parallel to the plane of the drawing in FIG. 10, and FIG. 12 shows an exploded illustration in which the bar 4 and the pretensioning spring 20 are illustrated in a manner removed from the frame 3. The sectional illustration according to FIG. 11 shows the groove 24 in which the pretensioning spring 20 is mounted in order to be supported on the frame 3. By way of its free ends 27, the pretensioning spring 20 is arranged in the receiving holes 26, provided for this purpose, in the bar 4. As a result, the pretensioning spring 20 can build up the desired pretension in the bar 4 with respect to the frame 3.

In all of the exemplary embodiments described thus far, the bar 4 crosses the belt receiving opening 2 in a direction orthogonally to the plug-in direction 28, in which the male connecting element 13 is introduced into the female connecting element 14 when the two buckle components 1 and 12 are plugged together. This is of course only an example. The bar 4 can also be arranged in the belt receiving opening 2 on the frame 3 in a manner parallel to the plug-in direction 28 or at some other angle relative thereto. For the sake of completeness, reference is also made to the fact that the frame 3, the bar 4 and also the belt receiving opening 2 can of course be embodied very differently and also in a manner deviating from the exemplary embodiments shown.

FIGS. 13 to 15 now show further variants of the invention, wherein a single buckle component 1 forms the entire buckle 11. Thus, no connecting elements 13 or 14 for connecting to another buckle component 12 are present on the buckle component 1. However, in the exemplary embodiments according to FIGS. 13 to 15, the bar 4 is fastened to the frame 3 in the belt receiving opening 2 as in the exemplary embodiments described above and therefore this does not need to be described once again. FIG. 15 shows a variant similar to FIGS. 10 to 12, in which the pretensioning spring 20 is provided.

FIGS. 13 and 14 also illustrate the belt 5 which is guided around the bar 4 in the belt receiving opening 2. In an analogous manner, the belt 5 can also be guided around the bar 4 in the above-described exemplary embodiments and also in the exemplary embodiment described below according to FIGS. 16 and 17, in the variants shown in FIGS. 13 and 14.

Figure 16:
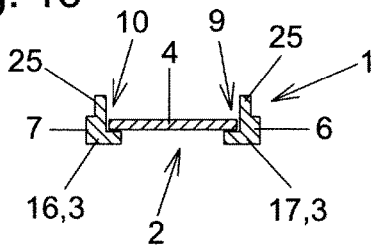
FIGS. 16 and 17 show schematic sectional illustrations of an exemplary embodiment according to the invention, wherein the frame for fastening the bar is plastically deformed.
Figure 17:
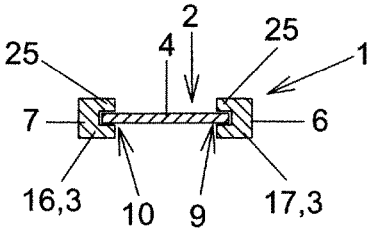

The exemplary embodiment according to FIGS. 16 and 17 schematically illustrates a variant in which the bar 4 is fastened to the frame 3 by plastic deformation of parts of the frame 3. Those parts of the frame 3 that are to be plastically deformed are the side walls 25. FIGS. 16 and 17 each show only sectional illustrations similar to FIGS. 2, 4, 6 and 8. The remaining structure of the buckle component 1 and of the buckle 11 can be realized as in the previously described exemplary embodiments. Of course, a large number of different alternative configurations thereof are also possible.

In FIG. 16, the side walls 25 are illustrated still in a bent-up starting position. In this position, the bar 4, as shown in FIG. 16, can be inserted into the frame 3. If the side walls 25 are then plastically deformed into the position according to FIG. 17, the frame 3 forms cross-sectionally C- or U-shaped regions 16 and 17, in the cross-sectionally blind-hole-like openings 9 and 10 of which the bar 4 is mounted. In this exemplary embodiment, the fastening devices 6 and 7 are thus part of the frame 3.

Whether the bar 4 is mounted as a clamping bar in the openings 9 and 10 so as to be displaceable in the belt receiving opening 2 or is fastened as a fixed bar that is fixed in position on the frame 3 ultimately depends, in this exemplary embodiment according to FIGS. 16 and 17, only on whether the extension of the openings 9 and 10 is greater in a direction orthogonally to the plane of the drawing than the width of the bar 4 in this direction or not. To this extent, it is also possible in these exemplary embodiments for both a clamping bar and a bar 4 that is fixed on the frame 3 to be realized. It is also possible in these configurations for connecting elements 13 or 14 for connecting to other buckle components 12 to be provided on the buckle component formed according to the invention. However, variants are also possible, such as those in FIGS. 13 to 15, in which no connecting elements 13 and 14 are provided and the buckle component 1 already forms the entire buckle 11.

KEY TO THE REFERENCE SIGNS

1 Buckle component
2 Belt receiving opening
3 Frame
4 Bar
5 Belt
6 Fastening device
7 Fastening device
8 Central bar part
9 Opening
10 Opening
11 Buckle
12 Buckle component
13 Connecting element
14 Connecting element
15 Frame wall
16 Region
17 Region
18 Locking lever
19 Belt receiving opening
20 Pretensioning spring
21 Pretensioning spring
22 Pivot axis
23 Shoulder
24 Groove
25 Side wall
26 Receiving hole
27 Free end
28 Plug-in direction

The invention claimed is:

1. A buckle component comprising a belt receiving opening, a frame enclosing the belt receiving opening, a bar about which the belt is guidable, wherein the bar is fastened to the frame in a manner crossing the belt receiving opening, by at least one fastening device of the bar, and the bar is fastened to the frame by the bar being plastically deformed, wherein the bar is originally in a first position and is plastically deformed to a second position such that the fastening devices move outwardly from an inside of the frame to engage the frame on an inner periphery of the belt receiving opening.

2. The buckle component according to claim 1, wherein the bar is fastened to the frame such that the bar completely crosses the belt receiving opening.

3. The buckle component according to claim 1, wherein there are two of the fastening devices, and the bar has a central bar part arranged between the fastening devices.

4. The buckle component according to claim 3, wherein the central bar part is plastically deformed.

5. The buckle component according to claim 1, wherein the at least one fastening device comprises a hook-shaped region on the bar that engages with the frame.

6. The buckle component according to claim 5, characterized in that the hook-shaped region is plastically deformed.

7. The buckle component according to claim 1, wherein there are two of the fastening device, and each comprises a hook-shaped region on each end of the bar that engage with the frame.

8. The buckle component according to claim 5, wherein the at least one hook-shaped region, in cross section, has a blind-hole-shaped opening in which a subregion of the frame is arranged.

9. The buckle component according to claim 1, wherein there are two of the fastening device, and each comprises a hook-shaped region on each end of the bar that engage with the frame, the hook-shaped regions, as seen in cross section, have a blind-hole-shaped opening in which a subregion of the frame is arranged, and the blind-hole-shaped openings are open in directions facing away from one another.

10. The buckle component according to claim 1, wherein the bar and the at least one fastening device are formed integrally of at least one continuous material.

11. A buckle comprising at least two buckle components which each have at least one connecting element for connecting to a corresponding connecting element of the other of the buckle components, wherein at least one of the buckle components is a buckle component according to claim 1.

12. A method for producing a buckle component according to claim 1, comprising fastening the bar to the frame by plastic deformation of the bar.

13. The buckle component according to claim 1, wherein the bar is work hardened by plastic deformation.

14. The buckle component according to claim 1, wherein the fastening devices are plastically deformed, and wherein, in the first position, the fastening devices are originally angled inward and, in the second position, the fastening devices are bent outward from the inside to engage the frame.

15. The buckle component according to claim 1, wherein the bar is plastically deformed, and wherein, in the first position, the bar is originally curved and, in moving to the second position, the bar is plastically deformed to reduce the curvature of the bar and cause the fastening devices to engage the frame.

16. The buckle component according to claim 1, wherein the at least one of the bar or the at least one of the fastening devices that is plastically deformed has bending lines in a cut through section thereof.

* * * * *